United States Patent [19]

Penniman

[11] Patent Number: 4,687,229

[45] Date of Patent: Aug. 18, 1987

[54] SPRING ACTUATED CLAMP

[75] Inventor: Richard E. Penniman, Gwynedd, Pa.

[73] Assignee: R. E. P. Industries Inc., Lansdale, Pa.

[21] Appl. No.: 812,533

[22] Filed: Dec. 23, 1985

[51] Int. Cl.[4] ..... B41L 3/00; B42D 17/00; B42F 1/00; B42F 5/00

[52] U.S. Cl. ..... 282/29 B; 281/45; 24/67.7; 24/67 R

[58] Field of Search ..... 282/29 B, 29 R; 281/45; 24/67 R, 67.3, 67.7, 499, 455, 500, 511, 508, 66; 16/291, 293, 296

[56] References Cited

U.S. PATENT DOCUMENTS

| | | | |
|---|---|---|---|
| 1,241,610 | 10/1917 | Dom | 24/67.7 |
| 1,370,852 | 3/1921 | Stinger | 24/67.7 |
| 1,632,459 | 6/1927 | Valkenburgh | 24/67.7 |
| 2,926,405 | 3/1960 | Moesch | 24/66 |
| 3,645,561 | 2/1972 | Kendall | 282/29 B |
| 3,752,504 | 8/1973 | Dixon | 282/29 B |

*Primary Examiner*—Paul A. Bell
*Assistant Examiner*—Paul M. Heyrana, Sr.
*Attorney, Agent, or Firm*—Seidel, Gonda, Goldhammer & Abbott

[57] ABSTRACT

A clamp for a posting board having a clamp arm and hinge which provides the desired clamping force to retain papers on the board, as desired, and also providing a continuous opening force when rotated beyond a fulcrum position defined by a pivoting extension tab of the hinge and a cantilevered leaf spring.

10 Claims, 4 Drawing Figures

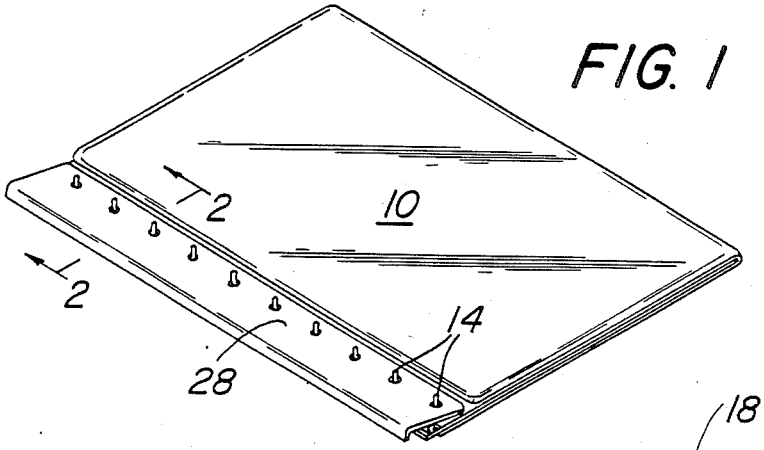
FIG. 1
FIG. 2
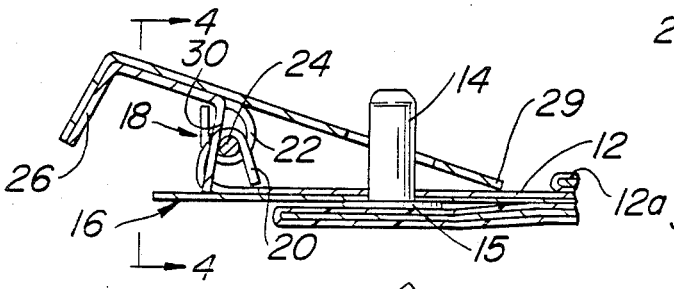
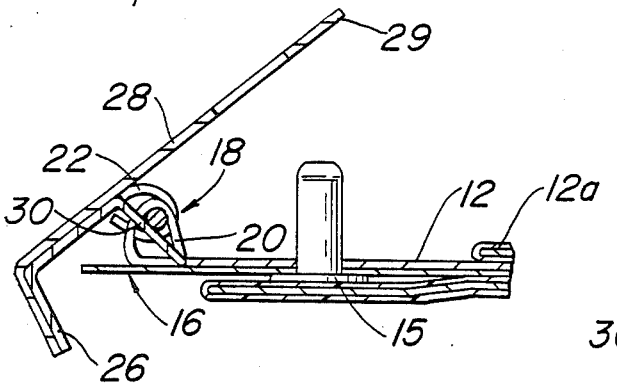
FIG. 3
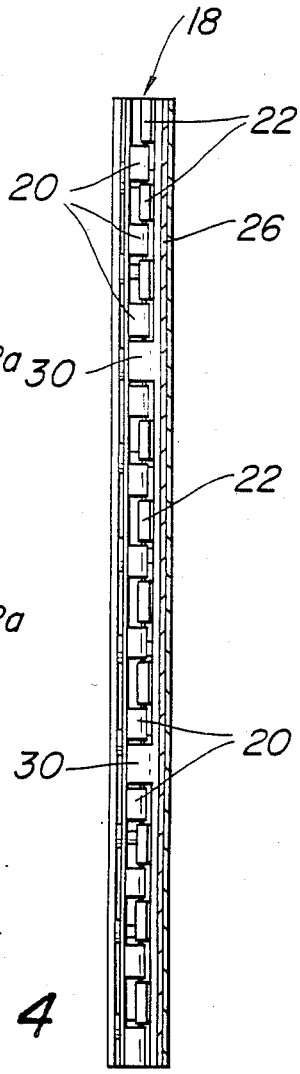
FIG. 4

SPRING ACTUATED CLAMP

BRIEF SUMMARY OF THE INVENTION

This invention relates to a clamping mechanism for a posting board which permits the retention of a plurality of loose materials such as forms or papers. The clamping mechanism may be used in conjunction with a board or writing support such that the papers or forms may be positioned and retained at selected locations on the board. The clamping mechanism provides both the proper clamping retention and an ease of form handling during removal.

BACKGROUND OF THE INVENTION

Typical spring actuated clamps are generally provided on a rigid writing support or board. A plurality of projecting pins which extend upwardly from the surface of the board may be provided adjacent to one lateral edge. The pins are normally positioned in a uniform spaced relationship such that a multiplicity of forms or papers can be placed at various locations on the pins in an overlaying relationship. This arrangement of forms permits an entry on a relatively upper form while creating a simultaneous entry (through the use of carbon or similar type material) on the lower forms. By changing the position of the forms on the pins, an entry may be made at any desired location on the lower forms.

Typically, known posting boards are provided with a spring actuated clamp or clip which retains the forms or loose materials on the board. The spring action of the clamp is normally created by a coil or helical type spring along with a hinge which causes a clamp arm to bias continually towards the surface of the board. The clamp hinge is generally fixed to the board surface, adjacent to one lateral edge. The clamp arm contacts the loose materials and retains them on the board. To open the clamp the spring bias of the hinge must be countered by an opening force which pivots the clamp arm away from the board surface. The loose materials may then be removed from the board or lifted off the pins, if so provided, and be repositioned at another location.

Clamps of this type make it awkward to remove and reposition papers and forms from under the clamp arm because a continous opening force must be applied to resist the spring bias of clamp arm. Additionally, coil or helical type springs often include exposed sharp edges which may cause injury to a user of the clamp or board.

SUMMARY OF THE INVENTION

The clamp of this invention creates a biasing action of a clamp arm against a reference surface, such as a board or writing support, by means of spring action about a fixed pivot axis. Specifically, the spring action is created by a flexible projection or leaf spring which is cantilevered from one lateral edge of the board or reference surface. A projecting tab attached to the clamp arm slidingly contacts the leaf spring creating a rotation of the clamp arm about the pivot axis of the hinge. An opening force or rotation of the clamp arm opposing the tab/leaf spring created bias causes the tab to slide across the surface of the leaf spring decreasing the moment arm of the force against the leaf spring while increasing its angle of contact until a fulcrum point is reached. The fulcrum point is defined as a point of equilibrium where the frictional contact of the tab with the surface of the spring and the spring angle is such that the resisting force created by the flexure of the cantilevered spring does not cause movement of the tab or rotation of the clamp about its hinge axis in either direction. A continued opening force past this fulcrum causes the biasing force to reverse such that the clamp arm rotates away from the reference surface without further application of an opening force. The reverse in the bias or rotational force direction is caused by a shift in the angle of contact with the spring surface. The angle of contact on the opposite side of the fulcrum causes a rotation of the clamp arm away from the board or reference surface. To close the clamp arm a closing force or reverse rotation must be applied against the, now, open bias force of the tab/leaf spring over the fulcrum position. Thus, the bias again reverses and the clamp arm will then continuously bear against the writing or reference surface.

Further advantages of the invention will become apparant to those skilled in the art by particularly pointing out a preferred embodiment of the invention.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 1 shows a perspective view of the preferred embodiment of the invention as attached to an accounting systems posting board.

FIG. 2 shows a partial cross sectional view of invention taken along line 2—2 in FIG. 1.

FIG. 3 shows a second partial cross sectional view of the invention shown in the open biased condition.

FIG. 4 shows an end view of the invention taken along line 4—4 in FIG. 2.

DETAILED DESCRIPTION OF THE INVENTION

The preferred embodiment of this invention as shown in the Figures is included on a multiple entry accounting systems posting board which is referred to in the drawings generally as the numeral 10. The systems posting board 10 generally comprises a flat board or writing surface 12 which is preferably made of a light weight and substantially rigid material such as cardboard or aluminum. The board may be provided with a cover or coating 12*a* of vinyl, leather or the like as desired. A series of pins 14 are shown, positioned in a linear fashion adjacent to one lateral edge of the board 12. The pins 14 project perpendicularly from the upper surface of the board 12.

The clamp of this invention generally comprises a flexible projection or leaf spring 16 which is cantilevered along one lateral edge of the board 12. The leaf spring 16 may be attached directly to the board 12 by any convenient means, such as rivets or welding, or may be maintained in its cantilevered relationship by a butt 15 on end of the pins 14, as shown in FIG. 2. The leaf spring 16 is shown to extend substantially along the entire length of the lateral edge of the board but may be provided at selective locations along the edge as desired.

A hinge 18 is attached to the board 12 adjacent to the cantilevered spring and generally formed by two sets of alternately engaging knuckles 20, 22 which wrap around a pivot axis defined by a hinge pin 24. One set of knuckles 20 may be attached directly to the board 12 by a welding or riveting means or may be integrally formed with the board 12. The pivoting or nonfixed set of knuckles 22 are attached to or integrally formed with a lifter arm 26 which, when the hinge 18 is assembled, extends away from the writing or reference surface of the board 12. Fixed to the lifter arm 26 is a clamp arm 28 which, when the clamp is in the closed or clamping position, contacts and bears against the forms or papers which are then retained on the board 12. The contact end 29 of the clamp arm 28 as shown engages the forms at a point on the opposite side of the pins 14 from the lateral edge or hinge 18 on the board 12. Apertures are provided in the clamp arm 28 such that the pins 14 project through the clamp arm 28 at various positions.

The biasing force of the hinge 18 is created by at least one projection or tab 30 which contacts the leaf. spring 16. The tab 30 may be attached to the pivoting set of knuckles 22, to the lifter arm 26 or may be integrally formed by straightening a curl of one of the pivoting knuckles 22 (FIG. 4). Tab 30 slidingly contacts the leaf spring 16 at a pivot point such that the clamp arm 28, when in its normal or closed position, is rotationally biased about the hinge pin 24 such that the clamp end 29 bears against the board 12 (FIG. 2).

Movement of the clamp arm 28 away from the board surface is induced by applying an opposing or opening force to lifter arm 26 causing a sliding motion of the tab 30 against the leaf spring 16. The opposing force causes a rotation of the clamp end 29 away from the surface of the board 12 and causes the pivot point of the tab 30 to change its angle of contact with respect to the leaf spring 16. The pivot point of the tab 30 reaches a fulcrum point on the leaf spring 16 upon reaching a position where the tab 30 is approximately perpendicular with respect to the surface of the cantilevered spring 16. Frictional forces created by the contact between the tab 30 and the leaf spring 16 as well as the direction of the force created by the flex of the cantilevered spring 16 may effect the exact angle of this fulcrum point. Further rotation of the clamp arm 28 about the hinge pin 24 past this fulcrum position will cause the biasing force of the spring 16 against the tab 30 to reverse direction. This reverse in biasing force causes the clamp end 29 to continuously rotate away from the surface of the board 12 and to remain in the open or raised position without the need for a continuous opening force (FIG. 3).

A closing rotational force (or clockwise directional force, as seen in FIG. 3) against the open clamp arm 28 in the open position will cause the tab 30 to move over its fulcrum point and cause a shift in the biasing force direction returning it to the normally closed condition, such that the clamp end 29 bears against the writing surface of the board 12.

This invention permits the clamp arm to remain in the open condition while positioning forms, loose papers or the like onto the board or pins without requiring a constant resistance force to oppose the spring bias action. This invention also supplies the necessary clamping action against the forms in its normally closed condition where the forms are properly positioned on the pins of the board.

The present invention may be embodied in other specific forms without departing from the spirit or essential attributes thereof and, accordingly, reference should be made to the appended claims, rather than to the foregoing specification, as indicating the scope of the invention.

I claim:

1. An apparatus comprising:

a posting board;

means defining a hinge provided along an edge of said board, said hinge means having a first knuckle means fixedly attached to said posting board and a second knuckle means including a lifter arm and an extension tab, said first and second knuckle means alternately engaging and rotationally pivoting about a hinge pin;

a flexible member cantilevered from the edge of said board;

a clamp arm attached to said lifter arm rotatable to a closed position in contact with said posting board, said extension tab contacting said member such that said clamp arm is biased toward said board when in said closed position, and said clamp arm being rotatable to an open position, said extension tab contacting said member to continually bias said clamp arm away from said board in said open position.

2. A clamp comprising:

hinge means having a hinge pin and first and second sets of alternately engaging knuckles pivoting about said hinge pin;

a leaf spring cantilevered from a fixed reference surface having a lateral edge;

a tab attached to said first set of knuckles, said tab slideably contacting said leaf spring;

a clamp arm attached to and rotating with said first set of knuckles, said clamp arm being baised towards said fixed reference surface when said tab contacts said spring on one side of a fulcrum and said clamp being biased away from said fixed reference surface when said tab contacts said spring on the opposite side of said fulcrum.

3. A clamp as claimed in claim 2 wherein said second set of interengaging knuckles is integrally formed with said surface.

4. A clamp as claimed in claim 2 further comprising a series of projecting pins, said pins arranged linearly adjacent to said hinge means on said fixed reference surface.

5. A clamp as claimed in claim 4 wherein said clamp arm contacts said fixed reference surface on the opposite side of said pins from said hinge means when said clamp arm is biased towards said fixed surface.

6. A clamp as claimed in claim 5 wherein said pins project through apertures provided in said clamp arm when biased towards said fixed reference surface.

7. A clamp as claimed in claim 4 wherein said pins are provided with a butt which engages said leaf spring to position said spring in its cantilevered fashion.

8. A clamp as claimed in claim 2 wherein said first and second set of interengaging knuckles are formed by a series of intermittently spaced curls which wrap around said hinge pin in an alternating relationship.

9. A clamp as claimed in claim 8 wherein said tab is formed by a straightened curl of said first set of knuckles.

10. A clamp comprising: hinge means having a hinge pin and first and second sets of alternately engaging knuckles pivoting about said hinge pin;

a body comprising a fixed reference surface having a lateral edge;

a leaf spring cantilevered from said lateral edge;

a tab attached to said first set of knuckles, and in contact with said leaf spring and said second set of knuckles being secured to said reference surface; and a clamp attached to and rotating with said first set of knuckles, and which upon rotation thereof causes sliding contact between said tab and leaf spring so as to produce a reaction force which upon closure of the clamp towards the reference surface acts on movement of said tab past said fulcrum point to maintain the clamp in a closed position and which upon opening of the clamp acts to maintain the clamp in the open position upon movement of said tab past said fulcrum point.

* * * * *